US010631108B2

(12) United States Patent
Dundas et al.

(10) Patent No.: US 10,631,108 B2
(45) Date of Patent: Apr. 21, 2020

(54) HEARING AUGMENTATION SYSTEMS AND METHODS

(71) Applicant: K/S HIMPP, Lynge (DK)

(72) Inventors: Drew Dundas, San Anselmo, CA (US); Steven Manser, Saratoga, CA (US); Daniel S Keller, Los Gatos, CA (US); Edward V Bacho, Sunnyvale, CA (US); Rodney C Perkins, Woodside, CA (US)

(73) Assignee: K/S HIMPP, Lynge (DK)

( * ) Notice: Subject to any disclaimer, the term of this patent is extended or adjusted under 35 U.S.C. 154(b) by 359 days.

(21) Appl. No.: 15/432,830

(22) Filed: Feb. 14, 2017

(65) Prior Publication Data

US 2017/0230766 A1 Aug. 10, 2017

Related U.S. Application Data

(63) Continuation-in-part of application No. 15/424,970, filed on Feb. 6, 2017, which is a continuation-in-part of application No. 15/425,011, filed on Feb. 6, 2017.
(Continued)

(51) Int. Cl.
*H04R 25/00* (2006.01)

(52) U.S. Cl.
CPC ..... *H04R 25/554* (2013.01); *H04R 2225/43* (2013.01); *H04R 2225/55* (2013.01)

(58) Field of Classification Search
CPC ..... H04R 25/554; H04R 2225/43; H04R 2225/55
(Continued)

(56) References Cited

U.S. PATENT DOCUMENTS 5,479,522 A 12/1995 Lindemann et al.
5,485,448 A 1/1996 Kishi et al.
(Continued)

FOREIGN PATENT DOCUMENTS

WO 0154458 A2 7/2001
WO 2015001135 A2 1/2015
(Continued)

OTHER PUBLICATIONS

Non-Final Office Action dated Jan. 8, 2018 in U.S. Appl. No. 15/424,985, 6 pages.
(Continued)

*Primary Examiner* — Sean H Nguyen
(74) *Attorney, Agent, or Firm* — William W. Cochran; Cochran Freund & Young LLC

(57) ABSTRACT

Various systems and methods are disclosed herein to increase the quality of the sound and intelligibility of speech delivered to a user by combining electric audio signals from more than one hearing assistance device that incorporates an active signal enhancement system. The method includes receiving electric audio signals at a first hearing assistance device, and sending electric audio signals to a second hearing assistance device. The electric audio signal is encoded as a replacement for input to an microphone channel located at the second hearing assistance device. The electric audio signals from the microphone located at the first hearing assistance device and the microphone located at the second hearing assistance device are combined. The combined electric audio signals are processed through a digital signal processor in the first hearing assistance device to enhance the amplitude of the desired signal via constructive interference. The combined signal is then routed through a multi-channel compressor in the first hearing assistance device to apply gain and frequency shaping as
(Continued)

appropriate for the hearing profile of the listener, converted to an analog signal in a digital-analog converter, and then transduced and output to the user.

15 Claims, 4 Drawing Sheets

Related U.S. Application Data

(60) Provisional application No. 62/357,469, filed on Jul. 1, 2016, provisional application No. 62/292,814, filed on Feb. 8, 2016, provisional application No. 62/292,803, filed on Feb. 8, 2016.

(58) Field of Classification Search
USPC ..... 381/315
See application file for complete search history.

(56) References Cited

U.S. PATENT DOCUMENTS

| | | | | |
|---|---|---|---|---|
| 5,721,783 | A | 2/1998 | Anderson | |
| 6,035,050 | A | 3/2000 | Weinfurtner et al. | |
| 6,108,486 | A | 8/2000 | Sawabe et al. | |
| 6,285,825 | B1 | 9/2001 | Miwa et al. | |
| 6,978,155 | B2 | 12/2005 | Berg | |
| 7,945,065 | B2 | 5/2011 | Menzl et al. | |
| 8,050,690 | B2 | 11/2011 | Neeraj | |
| 8,064,609 | B2 | 11/2011 | Baechler et al. | |
| 8,233,913 | B2 | 7/2012 | Mendis | |
| 8,379,871 | B2 | 2/2013 | Michael et al. | |
| 8,442,435 | B2 | 5/2013 | Jones et al. | |
| 8,503,703 | B2 | 8/2013 | Eaton et al. | |
| 8,903,431 | B2 | 12/2014 | Koch | |
| 8,995,688 | B1 * | 3/2015 | Chemtob | H04R 1/1091 381/109 |
| 9,049,525 | B2 | 6/2015 | Nielsen et al. | |
| 9,227,057 | B2 | 1/2016 | McElveen, Jr. | |
| 9,253,560 | B2 | 2/2016 | Goldstein et al. | |
| 9,439,008 | B2 | 9/2016 | Shennib | |
| 2004/0037442 | A1 | 2/2004 | Nielsen et al. | |
| 2005/0008176 | A1 | 1/2005 | Pedersen | |
| 2005/0255843 | A1 | 11/2005 | Hilpisch et al. | |
| 2005/0260985 | A1 | 11/2005 | Rader et al. | |
| 2006/0215845 | A1 | 9/2006 | Burleigh et al. | |
| 2007/0036364 | A1 | 2/2007 | Okuno | |
| 2007/0064954 | A1 | 3/2007 | Booth et al. | |
| 2007/0237346 | A1 | 10/2007 | Fichtl | |
| 2008/0049957 | A1 | 2/2008 | Topholm et al. | |
| 2009/0046871 | A1 * | 2/2009 | Oxford | H04S 7/306 381/98 |
| 2009/0074206 | A1 | 3/2009 | Bradford et al. | |
| 2009/0154741 | A1 | 6/2009 | Woods | |
| 2010/0009715 | A1 | 1/2010 | Enzmann | |
| 2011/0002490 | A1 | 1/2011 | Zukic | |
| 2011/0257974 | A1 | 10/2011 | Kristjansson et al. | |
| 2011/0280409 | A1 | 11/2011 | Michael et al. | |
| 2011/0293123 | A1 | 12/2011 | Neumeyer et al. | |
| 2011/0305345 | A1 * | 12/2011 | Bouchard | G10L 21/0208 381/23.1 |
| 2012/0051569 | A1 | 3/2012 | Blamey et al. | |
| 2012/0183165 | A1 | 7/2012 | Foo et al. | |
| 2012/0189140 | A1 | 7/2012 | Hughes | |
| 2013/0163797 | A1 | 6/2013 | Suzman et al. | |
| 2013/0195302 | A1 | 8/2013 | Meincke et al. | |
| 2013/0202131 | A1 | 8/2013 | Kemmochi et al. | |
| 2013/0308782 | A1 | 11/2013 | Dittberner et al. | |
| 2014/0023217 | A1 * | 1/2014 | Zhang | H04R 25/554 381/315 |
| 2014/0044269 | A1 | 2/2014 | Anderson | |
| 2014/0108149 | A1 | 4/2014 | Jabara et al. | |
| 2014/0112495 | A1 * | 4/2014 | Bodley | H04M 3/56 381/80 |
| 2014/0169601 | A1 | 6/2014 | Pedersen | |
| 2014/0193007 | A1 | 7/2014 | Solum et al. | |
| 2014/0254820 | A1 | 9/2014 | Gardenfors et al. | |
| 2014/0278589 | A1 | 9/2014 | Rados et al. | |
| 2014/0314245 | A1 | 10/2014 | Asada et al. | |
| 2015/0003652 | A1 * | 1/2015 | Bisgaard | H04R 25/50 381/314 |
| 2015/0124976 | A1 | 5/2015 | Pedersen et al. | |
| 2015/0326965 | A1 | 11/2015 | Sprague et al. | |
| 2016/0044425 | A1 | 2/2016 | Westergaard et al. | |
| 2016/0057547 | A1 | 2/2016 | Burger et al. | |
| 2016/0094921 | A1 | 3/2016 | Chen et al. | |
| 2016/0373869 | A1 * | 12/2016 | Gran | H04R 25/407 |
| 2017/0078809 | A1 | 3/2017 | Solum et al. | |
| 2017/0230762 | A1 | 8/2017 | Simonides et al. | |
| 2017/0230763 | A1 | 8/2017 | Simonides et al. | |
| 2017/0230764 | A1 | 8/2017 | Simonides et al. | |
| 2017/0230767 | A1 | 8/2017 | Simonides et al. | |
| 2017/0230788 | A1 | 8/2017 | Simonides et al. | |

FOREIGN PATENT DOCUMENTS

| | | | |
|---|---|---|---|
| WO | WO2015/028050 | A1 | 3/2015 |
| WO | 2017139218 | A1 | 8/2017 |
| WO | 2018005140 | A1 | 1/2018 |

OTHER PUBLICATIONS

Non-Final Office Action dated Jan. 3, 2018 in U.S. Appl. No. 15/424,992, 8 pages.

Non-Final Office Action dated Feb. 28, 2018 in U.S. Appl. No. 15/425,002, 9 pages.

Non-Final Office Action dated Jan. 4, 2018 in U.S. Appl. No. 15/425,011, 10 pages.

PCT Search Report—PCT/US2017/038075 (dated Oct. 18, 2017).

PCT Search Report—PCT/US2017/016660 (dated Jun. 27, 2017).

PCT Search Report—PCT/EP2013/067735 (dated May 22, 2014).

Elg, J: "Specification of the Bluetooth System, Core, Version 1.1, Part C, Link Manager Protocol, 3.1 General Response Messages, 3.2 Authentication, 3.3 Pairing, 3.4 Change Link Key, 3.5 Change Current Key." Specification of the Bluetooth System, XX, XX, Dec. 1, 1999.

* cited by examiner

400

HEARING AUGMENTATION SYSTEMS AND METHODS

CROSS REFERENCE TO RELATED APPLICATIONS

The present application claims benefit of priority to U.S. Prov. Pat. Application Ser. No. 62/292,803, filed Feb. 8, 2016 and entitled HEARING AUGMENTATION SYSTEMS AND METHODS, and to U.S. patent application Ser. No. 15/424,970, filed Feb. 6, 2017 and entitled HEARING AUGMENTATION SYSTEMS AND METHODS, and to U.S. Prov. Pat. Application Ser. No. 62/292,814, filed Feb. 8, 2016 and U.S. patent application Ser. No. 15/425,011, filed Feb. 6, 2017 and entitled HEARING AUGMENTATION SYSTEMS AND METHODS, and to U.S. Prov. Pat. Application Ser. No. 62/357,469, filed Jul. 1, 2016 and entitled HEARING AUGMENTATION SYSTEMS AND METHODS, all of which are hereby incorporated by reference in their entirety.

TECHNICAL FIELD

The present disclosure relates generally to personalized sound delivery and hearing systems, and more specifically, relates to a method and an active, adaptive system for the enhancement of speech clarity at a distance or in environments with interfering background noise through the combination of audio inputs from more than one hearing device.

BACKGROUND

Hearing assistance devices, such as hearing aids, include, but are not limited to, devices for use in the ear, in the ear canal, completely in the canal, and behind the ear. Such devices have been developed to ameliorate the effects of hearing losses in individuals. Hearing deficiencies can range from deafness to hearing losses where the individual has impairment responding to different frequencies of sound or to being able to differentiate sounds occurring simultaneously. The hearing assistance device in its most elementary form usually provides for auditory correction through the amplification and filtering of sound provided in the environment with the intent that previously inaudible sounds become audible while maintaining comfort for more intense sounds while the device is worn. Hearing aids employ different forms of amplification to achieve improved hearing. However, with improved amplification comes a need for noise reduction techniques to improve the listener's ability to distinguish amplified sounds of interest from those that are classified as noise. Incorporating active noise cancellation (ANC) systems within hearing assistance devices, namely hearing aids, has been documented by several claimants; however, incorporating both technologies is still primitive in its development. Typically, ANC and hearing aids work in opposite ways; hearing aids amplify sound and ANC attenuates sound. However, when combining a hearing aid and an ANC in a suitable way, it is possible to obtain the advantages and technical effects of both systems.

US2012/0250916 and WO2005052911 both relate to a hearing aid which can perform active noise cancellation. In WO2005052911, the hearing aid includes a signal processor which produces a compensation/cancellation signal that can attenuate acoustic signals that bypasses the signal path of the hearing aid and enters the ear canal. In US2012/0250916, the hearing aid includes two microphones and a control unit provided for adjusting a time delay of the two microphone signals.

WO06003618 relates to an earplug with a circuit for active noise cancellation. When a noise signal is received in the earplug, a cancelling signal is processed by means of the circuit to cancel the noise signal. U.S. Pat. No. 6,567,524 teaches a hearing protective earplug with an audio communication terminal for obtaining speech signals of high quality while attenuating noise. The earplug performs noise attenuation automatically adapted to the noise conditions and communication modes. U.S. Pat. Nos. 6,181,801 and 6,021,207 relate to a communications earpiece which receives audio signals, wired and wireless, respectively, sent from an external device such as a mobile phone. Ambient sounds are used for noise cancellation. The communications earpiece can be used by both hearing impaired and non-hearing impaired users.

In an ANC, anti-phasic, but equal amplitude sound is generated in the ear canal in an effort to cause destructive interference and thereby negate the presence of specific sounds. An example would be found in noise cancelling earphones, wherein low frequency, periodic noises like multi-talker babble or aircraft engine noise can be identified, their level and spectral content in the ear canal (or under a headphone) can be captured and analyzed. The phase path to the eardrum predicted, and a signal with equal intensity and frequency composition but 180° out of phase with the ambient sound is added, causing a reduction or elimination of the undesirable sound at the eardrum. However, ANCs typically require a microphone located in the ear canal to capture and analyze the magnitude and phase of the signal, and an algorithm present in the system to allow for the process.

SUMMARY

Various systems and methods are disclosed herein to combine electric audio signals from more than one hearing assistance device in order to enhance the ability to communicate effectively under adverse listening conditions through a process of adaptive constructive interference. For example, multiple users equipped with their respective hearing assistance devices may have the ability to connect to the individual devices of other local users in order to create a local area network of users who can then share acoustic information via a radio link for easier communication. Furthermore, the hearing assistance devices of both users collectively receive more electric audio signals than a single hearing assistance device receives. Therefore, incorporating the electric audio signals with the acoustic signal from the vicinity of the user's device allows for enhancement of the desired sounds such as conversational speech relative to the background of less desirable sound.

In an embodiment, a first hearing assistance device is connected to a second hearing assistance device via radio (for example, via Bluetooth radio or similar) to establish a secure, bidirectional, full duplex connection. Once connected, a microphone located at the first hearing assistance device generates electric audio signals, and sends the electric audio signals to the second hearing assistance device via the radio link. The electric audio signal is encoded as a replacement for input to a microphone input channel located at the second hearing assistance device. This signal is then combined with a signal captured by a second microphone on the second hearing assistance device. Similarly, electric audio signals received generated at the second hearing assistance device are transmitted to the first hearing assistance device and encoded as a replacement for input to a microphone channel located at the first hearing assistance device and combined with the signal captured by the second microphone on the first hearing device. The combined electric audio signals are processed through a digital signal processor in the local hearing assistance device and adaptively time-shifted in order to enhance the amplitude of the desired signal via constructive interference. The combined signal is then routed through a multi-channel compressor in the local hearing assistance device to apply gain and frequency shaping as appropriate for the hearing profile of the listener, converted to an analog signal in a digital-analog converter, and then transduced and output to the user's ear.

Multiple users and hearing assistance devices can be employed. For example, a third hearing assistance device may be configured to receive electric audio signals from both microphones located at the first and second hearing assistance devices. The electric audio signal from both microphones located at the first and second hearing assistance devices is combined and encoded as a replacement for input to a microphone channel located at the third hearing assistance device. The electric audio signal received from the microphone at the third hearing assistance device may be combined with the electric audio signals received from both microphones located at the first and second hearing assistance devices. Simultaneously, electric audio signals from the second and third hearing assistance devices can be transmitted to the first hearing assistance device. Furthermore, electric audio signals from the first and third hearing assistance devices can be transmitted to the second hearing assistance device. This approach can be expanded to encompass larger numbers of devices.

Because each hearing assistance device employs the other's microphone, each hearing assistance device is enabled to exploit the spatial differences between the two hearing assistance devices and environment noise. By combining these input signals it is possible to enhance the signal contributions from desirable speech that originates in the immediate vicinity of the environment noise, which means that both the signal to noise ratio SNR and the speech intelligibility SI can be improved locally at each hearing assistance device. In an alternative embodiment, this technique can be employed in non-acoustic hearing enhancement devices such as cochlear implants, bone anchored hearing devices, contact hearing devices, implantable hearing devices and in other methods of stimulating the auditory system.

Accordingly, in some embodiments the disclosed systems and methods are developed to more effectively rate the noise level and quality of various locations. For instance, a system may include a hearing assistance device (e.g. hearing aid) and an integrated control, for instance a mobile phone or computing device that is wirelessly linked to the sound delivery device. The microphones on the sound delivery device and/or the associated mobile device may then detect sound levels at different locations at different times. Significant data can be collected from different users to be aggregated and uploaded to a server for analysis to determine the current or average sound levels at particular establishments. Accordingly, a database can be created that includes sound level and characteristic information for different cities, restaurants, sporting venues, public transportation, and others places. These sound level ratings may then be aggregated by a server in a database and accessed by users through an application on their mobile device, website, or through integration into websites that combine feedback on establishments. Furthermore, GPS data can be tagged to the sound level data recorded through the microphones to identify the location. Additionally, signal-to-noise ratio, and time-stamp data maybe tagged to the sound level. Alternatively, users can tag or indicate which establishment they are attending after receiving notifications on their mobile device or any combination of the tagging methods for confirmation.

BRIEF DESCRIPTION OF THE DRAWINGS

The accompanying drawings, which are incorporated in and constitute a part of this specification, exemplify the embodiments of the present invention and, together with the description, serve to explain and illustrate principles of the invention. The drawings are intended to illustrate major features of the exemplary embodiments in a diagrammatic manner. The drawings are not intended to depict every feature of actual embodiments nor relative dimensions of the depicted elements, and are not drawn to scale.

Figure 1:
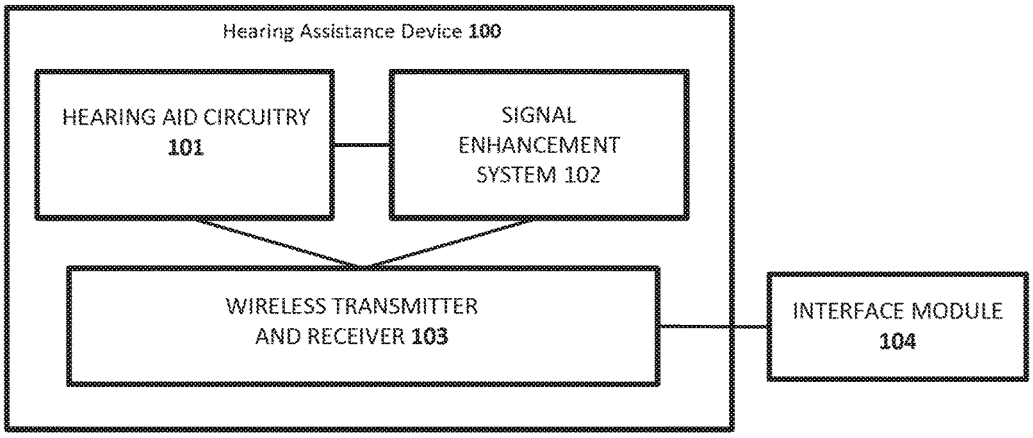
FIG. 1 is an overview of an exemplary hearing assistance device in accordance with the present disclosure.

In the drawings, the same reference numbers and any acronyms identify elements or acts with the same or similar structure or functionality for ease of understanding and convenience. To easily identify the discussion of any particular element or act, the most significant digit or digits in a reference number refer to the Figure number in which that element is first introduced.

DETAILED DESCRIPTION

Various examples of the invention will now be described. The following description provides specific details for a thorough understanding and enabling description of these examples. One skilled in the relevant art will understand, however, that the invention may be practiced without many of these details. Likewise, one skilled in the relevant art will also understand that the invention can include many other obvious features not described in detail herein. Additionally, some well-known structures or functions may not be shown or described in detail below, so as to avoid unnecessarily obscuring the relevant description.

The terminology used below is to be interpreted in its broadest reasonable manner, even though it is being used in conjunction with a detailed description of certain specific examples of the invention. Indeed, certain terms may even be emphasized below; however, any terminology intended to be interpreted in any restricted manner will be overtly and specifically defined as such in this Detailed Description section.

FIG. 1 is a schematic block diagram of an exemplary hearing assistance device 100 that includes a hearing aid circuitry 101, an active signal enhancement system 102, and a wireless transmitter and receiver 103. The wireless transmitter and receiver 103 is connected to an interface module 104. The hearing assistance device 100 is connected to at least one other hearing assistance device to establish a secure, bidirectional, full duplex connection via the wireless transmitter and receiver 103. The wireless transmitter and receiver 103 is configured to send and receive data via Near Field Communication (NFC), WiFi®, Bluetooth®, another wireless technology to other hearing assistance devices, mobile devices, tablets, laptops, computers, etc. Connection between the hearing assistance device 100 and other hearing assistance devices can be facilitated at the interface module 104. The interface module 104 may include for example, mobile devices, tablets, laptops, computers, etc., equipped with a user interface.

In a preferred embodiment, the hearing assistance device 100 may connect to another hearing device via Bluetooth® pairing, facilitated by a user located at a mobile device, also paired with the hearing assistance device 100. In an alternative embodiment, the wireless transmitter and receiver 103 may include a short-range wireless communication system, commonly known as Near Field Communication (NFC). The NFC circuit is a two-way communication circuit comprising both a transmitter and a receiver. NFC is a mainly inductive communication system, which has a very short effective transmission range, such as approximately 5-6 centimeters. The protocol used for wireless near field communication via NFC is well described. Using NFC enables a user to simplify the otherwise cumbersome Bluetooth® pairing procedure by temporarily bringing a mobile device comprising both Bluetooth® and NFC circuitry within the effective NFC transmission range of 5-6 centimeters of another device, which also comprises both Bluetooth® and NFC circuitry, e.g. an after-market headset, and then let the NFC circuits automatically exchange information between the devices, in order to perform the Bluetooth® pairing procedure of the two devices. After the pairing, the two paired devices are separated again but will now be able to communicate via Bluetooth® or other method of transmitting and receiving digital audio signals, e.g. streaming audio to the head-set from the mobile phone and vice versa, as long as they are within the Bluetooth® communication range. The NFC is used where the two devices are close together for exchange of critical pairing information, and after separation of the devices, it is no longer used for any communication between the devices.

Figure 2:
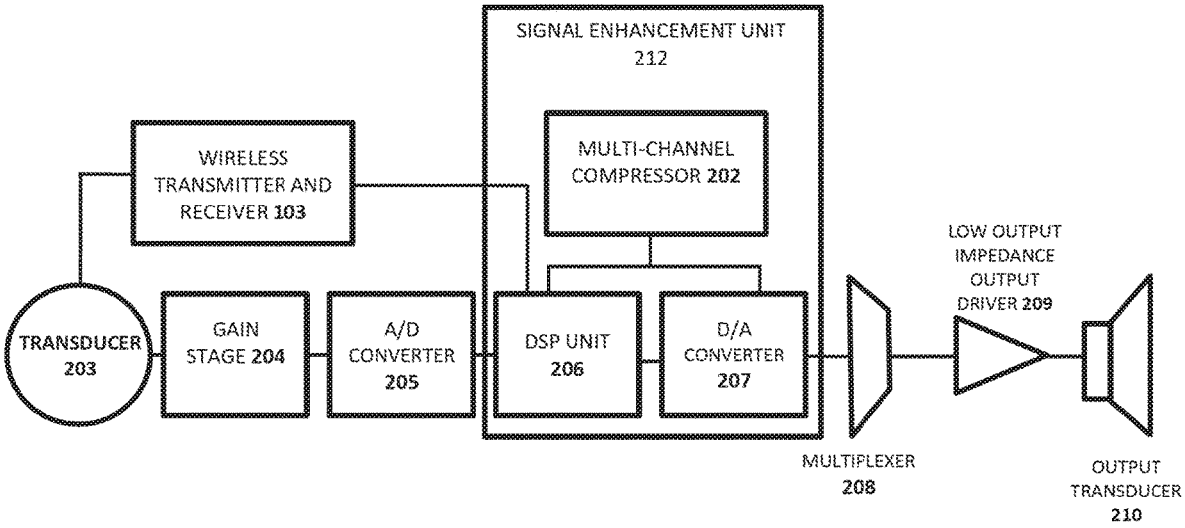
FIG. 2 is a schematic block diagram of an exemplary hearing assistance device in accordance with the present disclosure.

Referring now to FIG. 2, a schematic block diagram of an exemplary hearing aid circuitry 101 is discussed. In one embodiment, the hearing aid circuitry 101 can include a signal path comprising one input transducer 203, e.g. a microphone. The input transducer 203 can be pointed outward towards the ambient space surrounding the hearing device user. The input transducer 203 can convert an ambient sound entering the ear of the user from the ambient space to an electric signal. Even though one input transducer is shown in the figure, it is understood that there can be more than one input transducer and more than one signal path. The input transducer 203 generates electric audio signals, and sends the electric audio signals to a wireless transmitter and receiver 103 to send to a second hearing aid (not pictured). In addition, the second hearing aid (not pictured) can send electric audio signals received from its input transducer to the current wireless transmitter and receiver 103.

The electric signal is communicated to the wireless transmitter and receiver 103, where it can be sent to another hearing assistance device. Likewise, electric audio signals can be received from the wireless transmitter and receiver 103. In one embodiment, electric audio signals from the transducer 203 can be sent to a gain stage 204 in which the electric audio signals are amplified. From the gain stage 204, the signal is communicated to an analog-to-digital (A/D) converter 205, which converts the amplified analog electric signal to a digital signal. The signal is then processed through an active signal enhancement unit 212. In the active signal enhancement unit 212, input from the transducer 203 goes to a digital signal-processing (DSP) unit 206 via the gain stage 204 and A/D converter 205 where signal peaks are time aligned with the signal from the wireless transmitter and receiver 103 to generate constructive interference. This process is discussed in further detail below.

The digital electric signal is communicated to a multichannel compressor 202 in the local hearing assistance device to reduce the digital noise. The digital noise reduction processing is applied to avoid amplifying undesirable, random environmental noise. The enhancement of desirable signals occurs by the combination of the signal obtained at a remote location with the signal obtained at the local location. If the signals are appropriately time shifted to align the peaks of the signal, the result is a more robust representation of the desired signal, and theoretically no enhancement of the less desirable competing noise. Moreover, the combined signal is then routed to a digital signal-processing (DSP) unit 206 to apply gain and frequency shaping as appropriate for the hearing profile of the listener, converted to an analog signal in a digital-analog converter 207, and then transduced and output to the user. The digital signal-processing (DSP) unit 206 is adapted to process the digital electric signal in accordance with a desired correction of the hearing loss specific for the user of the hearing device. The digital electric signal is communicated to a digital-to-analogue (D/A) converter 207, which converts the digital electric signal to an analog pulse density modulated (PDM) electric signal. The analog electric signal is communicated to a multiplexer 208, and then to a low output impedance output driver 209. Finally the analog PDM electric signal can be communicated to an output transducer 210, e.g. a speaker within the ear canal, which converts the electric signal to a sound pressure signal affecting the tympanic membrane in the residual volume of the ear canal (not shown).

FIG. 2 also exemplifies the active signal enhancement unit 212 of the hearing assistance device 100. The signal enhancement system 102 improves signal to noise ratio by increasing the amplitude of the desirable signal via proximity and constructive interference while relatively preserving the undesired background noise (which is typically assumed to be diffuse and effectively random). Digital noise reduction processing is applied later in the chain to attempt to avoid amplifying undesirable, random environmental noise. The enhancement of desirable signals occurs by the combination of the signal obtained at a remote location with the signal obtained at the local location. If the signals are appropriately time shifted to align the peaks of the signal, the result is a more robust representation of the desired signal, and theoretically no enhancement of the less desirable competing noise.

The signal enhancement unit 212 may be configured to enhance speech clarity at a distance or in environments with interfering background noise through the combination of audio inputs from more than one hearing device. Noise may be unwanted audio signals that disturb the hearing device user.

The signal enhancement unit 212 enhances speech intelligibility performance in noise with this system by strategically placing the microphone in proximity to a discreet signal source. This heavily influences the amplitude of the signal that is transduced. Thus, placing a microphone at a distance of 6" from the signal source (for example, in the ear of the person who is talking, 6" away from their mouth), will result in a signal with a far better signal to noise ratio than if that microphone is placed on a table in front of the talker at a distance of 24". This relationship is governed by Sound Pressure Level (SPL) laws when the noise environment is assumed to be diffuse (having the same intensity at any location in the environment). While no environment is truly diffuse, a good approximation suggests that for every doubling of distance from the source, the signal intensity will drop by 6 dB. The noise intensity, however, will not decrease. Thus, in the example above, if the signal to noise ratio (SNR) with the microphone at 6" from the talker's mouth is assumed to be +18 dB, the SNR with the microphone placed on the table at 24" would be estimated to fall by 12 dB to only +6 dB (two doublings of distance). Across the table at the ear of the listener, without a wireless transmission of sound information, the SNR would approach 0 dB as the distance between talker and listener approached 48". That is, the speech would be less and less distinguishable from the background noise. Thus, combining the audio signal collected at the talker's ear with the audio signal collected at the listener's ear restores a great deal of the contrast between signal and noise, making the talker's voice 'pop' out of the background. As a result, the remote microphone is able to capture the desirable signals and the effect of time aligning peaks in the two or more signals results in an enhancement of signal magnitude. Therefore, the speech intelligibility of sound sources that are at a distance from the talker and the listener (e.g., in between or to the side of the two) is enhanced, as the signal is enhanced via constructive interference and proximity effects, while the noise, being random, is not.

Figure 3:
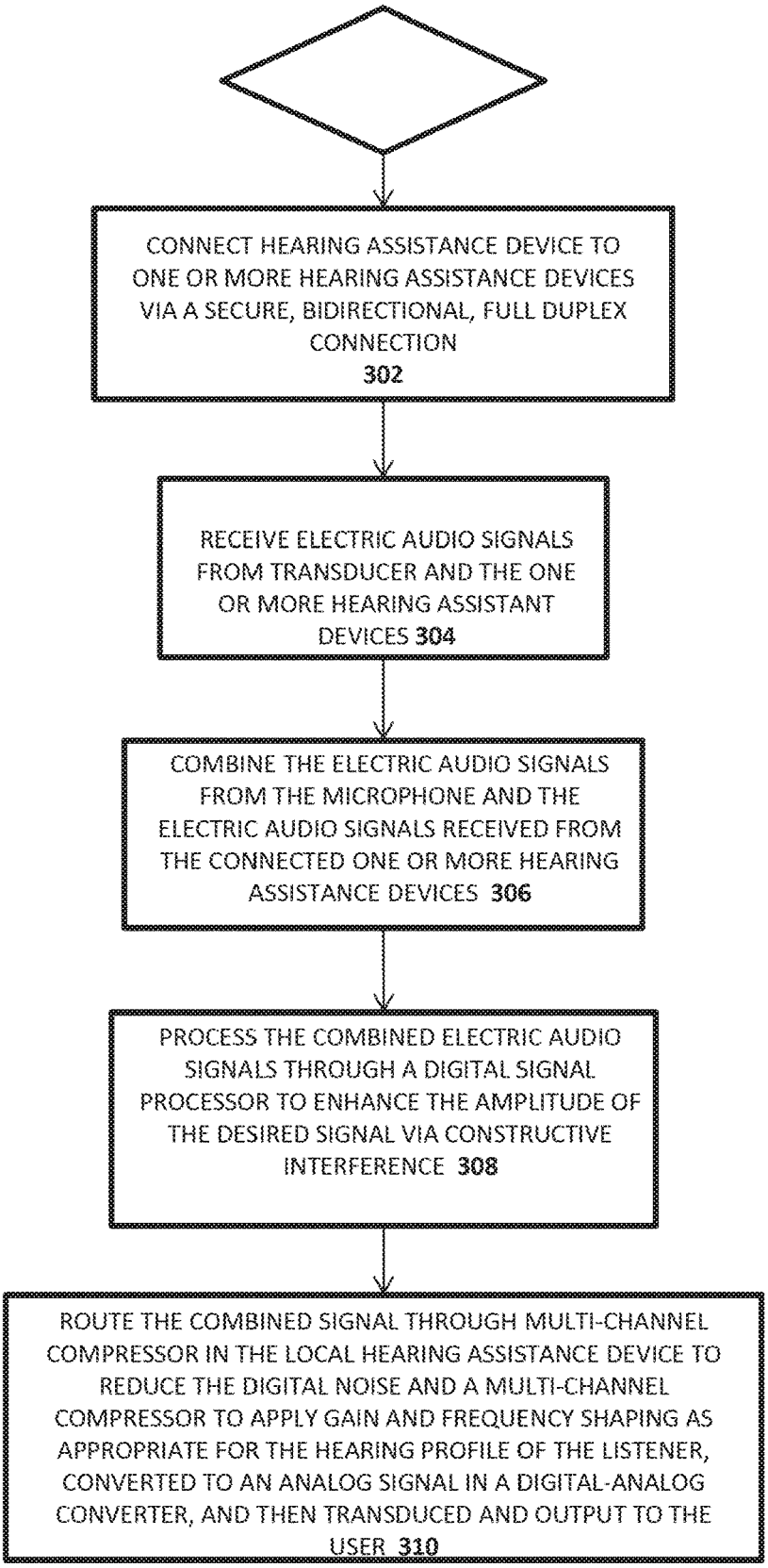
FIG. 3 is a flow chart illustrating a process for combining electric audio signals from more than one hearing assistance device that incorporates an active signal enhancement system in accordance with the present disclosure.

Referring now to FIG. 3, which exemplifies a flow chart illustrating a process for combining electric audio signals from more than one hearing assistance device that incorporates an active noise cancellation system in accordance with the present disclosure. As described above, the hearing assistance device 100 may be connected to one or more hearing assistance devices via a secure, bidirectional, full duplex connection at step 302. Once connected, a microphone located at the hearing assistance device 100 can receive electric audio signals, at step 304. In addition, electric audio signals received at the one or more hearing assistance devices may be sent to the hearing assistance device to be combined with the electric audio signals received at the microphone. In an embodiment, the electric audio signal is encoded as a replacement for input to a microphone channel. At step 306, both the electric audio signals from the microphone located at the first hearing assistance device and the electric audio signals received from the connected one or more hearing assistance devices are combined. The combined electric audio signals are processed through a digital signal processor in the hearing assistance device to enhance the amplitude of the desired signal via constructive interference, at step 308. Specifically, the magnitude of the desirable signal is increased via proximity and constructive interference while relatively preserving the undesired background noise. At step 310, the combined signal is then routed through a multi-channel compressor in the local hearing assistance device to reduce the digital noise. The digital noise reduction processing is applied to avoid amplifying undesirable, random environmental noise. The enhancement of desirable signals occurs by the combination of the signal obtained at a remote location with the signal obtained at the local location. If the signals are appropriately time shifted to align the peaks of the signal, the result is a more robust representation of the desired signal, and theoretically no enhancement of the less desirable competing noise. Moreover, the combined signal is then routed to a digital signal-processing (DSP) unit to apply gain and frequency shaping as appropriate for the hearing profile of the listener, converted to an analog signal in a digital-analog converter, and then transduced and output to the user.

Figure 4:
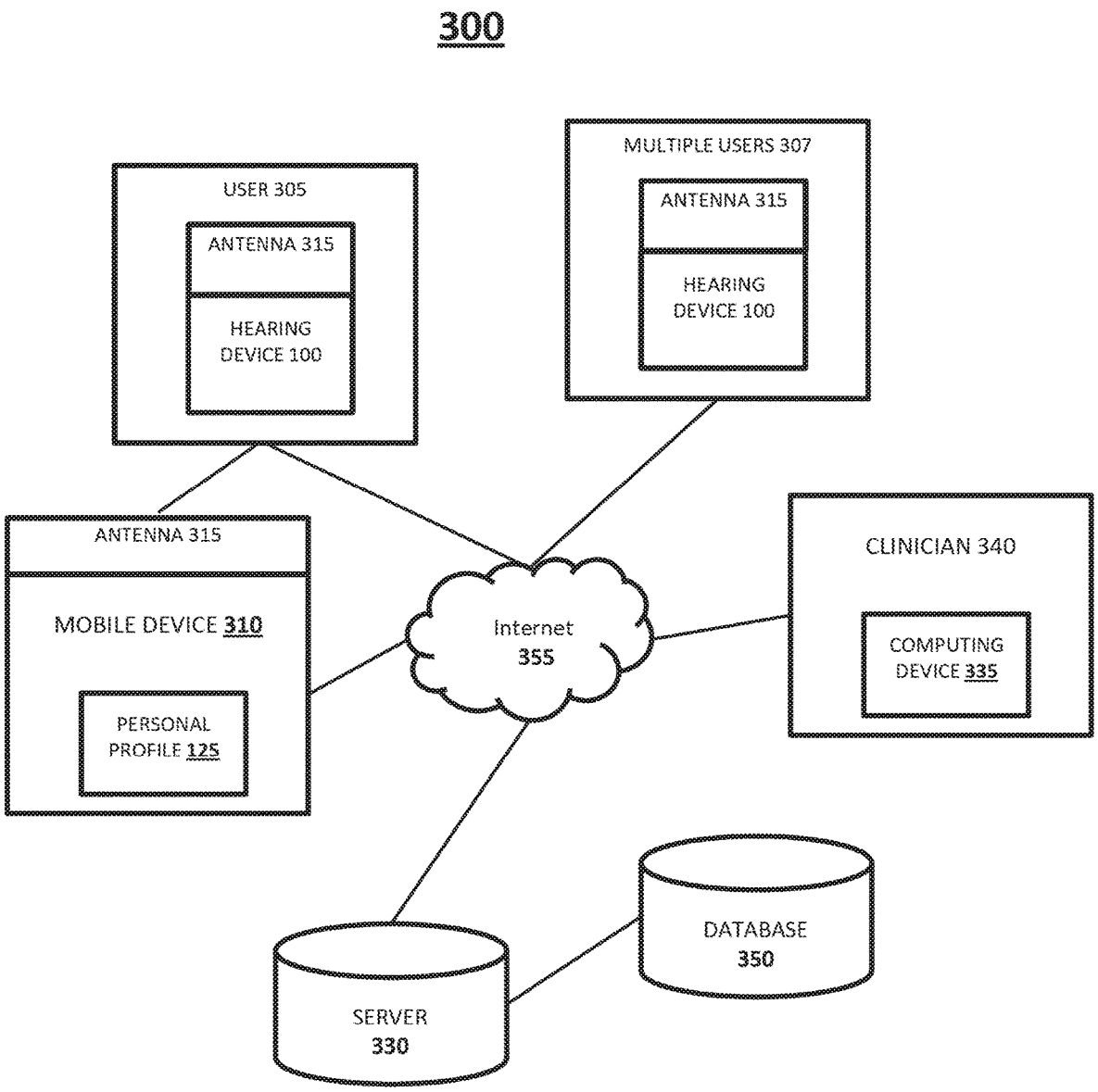
FIG. 4 is an overview of an example hearing system in accordance with the present disclosure.

FIG. 4 illustrates an overview of an example hearing system 300 according to the present disclosure. The system 300 may include a first hearing assistance device 100 associated with a first user 305 and connected to a first mobile device 310 linked with the hearing assistance device 100 using antennas 315, and a personal profile 125 associated with the first user 305 may be stored optionally on the mobile device 310 or elsewhere (e.g., server 330 via connection over the Internet or other communications network). In some embodiments, the hearing assistance device 100 may include a charging case that can store the audio data, and the audio data may be uploaded to a computer (for instance for users without a mobile device) which could then upload data over the network 355 to a server 330. Additionally, a network 355 may also link the mobile device 310 and/or hearing assistance device 100 to a server 330 and database 350 that stores personal profiles, including software for analysis of sound data and performing other functions as disclosed herein. Furthermore, other users 307 with one or more other hearing assistance devices 100 may also be linked to the network 355 and server 330 and sound/hearing data from the other users 307 may be aggregated and stored in the database 350. In addition, a clinician 340 may be connected to the network 355 via a computing device 335 to allow the user to diagnose and make changes to the settings of the hearing assistance devices 100. The changes made by clinicians 340 may also be stored in the database 350 for separate or combined reference. This will allow the clinician to remotely monitor the listening environment, assess system efficacy for users 305, 307 and propose then implement and test changes to one or more of the hearing devices 100 while the associated user is in a noisy environment or other listening situation of particular concern to affected users. Although not shown, and as described below with reference to FIG. 5, hearing assistance device 100 associated with first user 305 may be in communication, such as via radio link, with one or more other hearing assistance devices 100 associated with one or more other users 307 and related hearing/audio signal data may be shared among the devices. Other users 307 also may have other mobile devices, such as smart phones, connected respectively to associated hearing assistance device 100.

The hearing system 300 efficiently optimizes the hearing assistance device 100 in certain environments based on an accumulation of data from both the user 305 and other users 307, and in some cases the clinician 340. This accumulated data can be utilized to present the user options or automatically set the audio settings on a user's hearing assistance device 100. Furthermore, this data may be utilized by clinicians to evaluate certain settings and improve their recommended settings for a given user 305 and noise environment.

Significant data can be collected from different users to be aggregated and uploaded to a server for analysis to determine the current or average sound levels at particular establishments. Accordingly, a database could be created that includes sound level and characteristic information for different cities, restaurants, sporting venues, public transportation, and others places. These sound level ratings may then be aggregated by a server in a database and accessed by users through an application on their mobile device, website, or through integration into websites that combine feedback on establishments. Furthermore, GPS data can be tagged to the sound level data recorded through the microphones to identify the location. Additionally, signal-to-noise ratio, and time-stamp data maybe tagged to the sound level. Alternatively, users can tag or indicate which establishment they are attending after receiving notifications on their mobile device or any combination of the tagging methods for confirmation.

Figure 5:
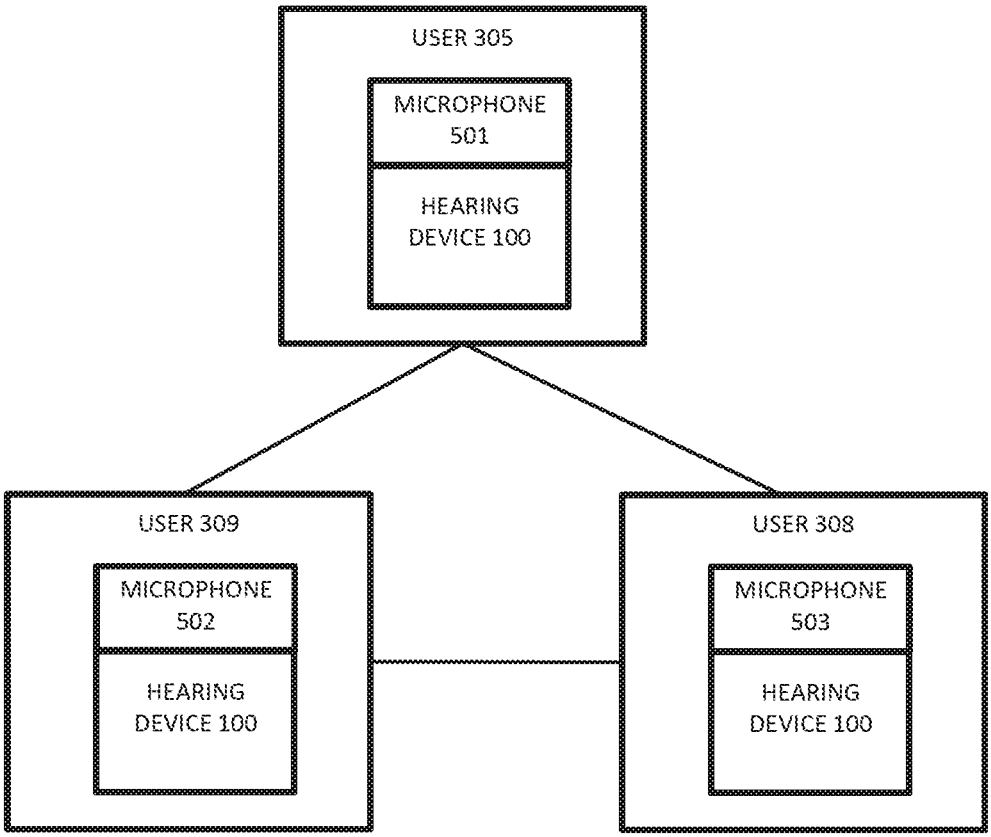
FIG. 5 is an overview of an example hearing system where multiple users and hearing assistance devices are employed in accordance with the present disclosure.

FIG. 5 illustrates an overview of an example hearing system 400 where multiple users and hearing assistance devices are employed. For example, user 305 equipped with a hearing assistance device 100 may be configured to receive electric audio signals from both microphones 502 and 503 located at users 308 and 309 hearing assistance devices 100. The electric audio signal from both microphones 502 and 503 located at the users 308 and 309 hearing assistance devices 100 are encoded as a replacement for input to a microphone 501 channel located at the hearing assistance device 100 associated with user 305. The electric audio signal received from microphone 501 at the hearing assistance device 100 associated with user 305 may be combined with the electric audio signals received from microphones 502 and 503 located at the hearing assistance devices 100 associated with users 308 and 309. Simultaneously, electric audio signals from the hearing assistance devices 100 associated with users 305 and 309 can be transmitted to the hearing assistance device 100 associated with user 308. Furthermore, electric audio signals from the hearing assistance devices 100 associated with users 305 and 308 can be transmitted to the hearing assistance device 100 associated with user 309. This approach can be expanded to encompass larger numbers of devices.

Particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results.

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable sub combination. Moreover, although features may be described above as acting in certain combinations and even initially claimed as such, one or more features from a claimed combination can in some cases be excised from the combination, and the claimed combination may be directed to a sub combination or variation of a sub combination.

Similarly, while operations may be depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products.

It should initially be understood that the disclosure herein may be implemented with any type of hardware and/or software, and may be a pre-programmed general purpose computing device. For example, the system may be implemented using a server, a personal computer, a portable computer, a thin client, or any suitable device or devices. The disclosure and/or components thereof may be a single device at a single location, or multiple devices at a single, or multiple, locations that are connected together using any appropriate communication protocols over any communication medium such as electric cable, fiber optic cable, or in a wireless manner.

It should also be noted that the disclosure is illustrated and discussed herein as having a plurality of modules that perform particular functions. It should be understood that these modules are merely schematically illustrated based on their function for clarity purposes only, and do not necessary represent specific hardware or software. In this regard, these modules may be hardware and/or software implemented to substantially perform the particular functions discussed. Moreover, the modules may be combined together within the disclosure, or divided into additional modules based on the particular function desired. Thus, the disclosure should not be construed to limit the present invention, but merely be understood to illustrate one example implementation thereof.

The computing system can include clients and servers. A client and server are generally remote from each other and typically interact through a communication network. The relationship of client and server arises by virtue of computer programs running on the respective computers and having a client-server relationship to each other. In some implementations, a server transmits data (e.g., an HTML page) to a client device (e.g., for purposes of displaying data to and receiving user input from a user interacting with the client device). Data generated at the client device (e.g., a result of the user interaction) can be received from the client device at the server.

Implementations of the subject matter described in this specification can be implemented in a computing system that includes a back-end component, e.g., as a data server, or that includes a middleware component, e.g., an application server, or that includes a front-end component, e.g., a client computer having a graphical user interface or a Web browser through which a user can interact with an implementation of the subject matter described in this specification, or any combination of one or more such back-end, middleware, or front-end components. The components of the system can be interconnected by any form or medium of digital data communication, e.g., a communication network. Examples of communication networks include a local area network ("LAN") and a wide area network ("WAN"), an internetwork (e.g., the Internet), and peer-to-peer networks (e.g., ad hoc peer-to-peer networks).

Implementations of the subject matter and the operations described in this specification can be implemented in digital electronic circuitry, or in computer software, firmware, or hardware, including the structures disclosed in this specification and their structural equivalents, or in combinations of one or more of them. Implementations of the subject matter described in this specification can be implemented as one or more computer programs, i.e., one or more modules of computer program instructions, encoded on computer storage medium for execution by, or to control the operation of, data processing apparatus. Alternatively or in addition, the program instructions can be encoded on an artificially-generated propagated signal, e.g., a machine-generated electrical, optical, or electromagnetic signal that is generated to encode information for transmission to suitable receiver apparatus for execution by a data processing apparatus. A computer storage medium can be, or be included in, a computer-readable storage device, a computer-readable storage substrate, a random or serial access memory array or device, or a combination of one or more of them. Moreover, while a computer storage medium is not a propagated signal, a computer storage medium can be a source or destination of computer program instructions encoded in an artificially-generated propagated signal. The computer storage medium can also be, or be included in, one or more separate physical components or media (e.g., multiple CDs, disks, or other storage devices).

The operations described in this specification can be implemented as operations performed by a "data processing apparatus" on data stored on one or more computer-readable storage devices or received from other sources.

The term "data processing apparatus" encompasses all kinds of apparatus, devices, and machines for processing data, including by way of example a programmable processor, a computer, a system on a chip, or multiple ones, or combinations, of the foregoing apparatus can include special purpose logic circuitry, e.g., an FPGA (field programmable gate array) or an ASIC (application-specific integrated circuit). The apparatus can also include, in addition to hardware, code that creates an execution environment for the computer program in question, e.g., code that constitutes processor firmware, a protocol stack, a database management system, an operating system, a cross-platform runtime environment, a virtual machine, or a combination of one or more of them. The apparatus and execution environment can realize various different computing model infrastructures, such as web services, distributed computing and grid computing infrastructures.

A computer program (also known as a program, software, software application, script, or code) can be written in any form of programming language, including compiled or interpreted languages, declarative or procedural languages, and it can be deployed in any form, including as a stand-alone program or as a module, component, subroutine, object, or other unit suitable for use in a computing environment. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub-programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform actions by operating on input data and generating output. The processes and logic flows can also be performed by, and apparatus can also be implemented as, special purpose logic circuitry, e.g., an FPGA (field programmable gate array) or an ASIC (application-specific integrated circuit).

Processors suitable for the execution of a computer program include, by way of example, both general and special purpose microprocessors, and any one or more processors of any kind of digital computer. Generally, a processor will receive instructions and data from read-only memory or random access memory or both. The essential elements of a computer are a processor for performing actions in accordance with instructions and one or more memory devices for storing instructions and data. Generally, a computer will also include, or be operatively coupled to receive data from or transfer data to, or both, one or more mass storage devices for storing data, e.g., magnetic, magneto-optical disks, or optical disks. However, a computer need not have such devices. Moreover, a computer can be embedded in another device, e.g., a mobile telephone, a personal digital assistant (PDA), a mobile audio or video player, a game console, a Global Positioning System (GPS) receiver, or a portable storage device (e.g., a universal serial bus (USB) flash drive), to name just a few. Devices suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in, special purpose logic circuitry.

The invention claimed is:

1. A method for combining electric audio signals from a plurality of hearing assistance devices worn by a plurality of different users that incorporate an active signal enhancement system comprising:

connecting a first hearing assistance device worn by a first user to other additional hearing assistance devices of said plurality of hearing devices that are worn by other users via a secure, bidirectional, full duplex connection;

receiving at said first hearing assistance device, worn by said first user, a plurality of audio signals from said plurality of additional hearing assistance devices worn by said other users;

generating a local audio signal from said first hearing assistance device;

combining said plurality of audio signals from said plurality of additional hearing devices with said local audio signal from said first hearing assistance device to create a combined audio signal;

processing said combined audio signal with a digital signal processor by adaptive time shifting said plurality of audio signals from said plurality of additional hearing devices, based upon spatial separation of said first hearing device from said additional hearing devices, to enhance signal amplitude via constructive interference of said local audio signal with said plurality of audio signals to create a processed constructive interference signal;

routing said processed constructive interference signal through a multi-channel compressor to apply gain processing and frequency shaping to create a gain processed and frequency shaped signal;

using a digital-analog converter that converts said gain processed and frequency shaped signal to an analog signal; and applying said audio signal to said first hearing assistance device.

2. The method of claim 1, wherein said secure, bidirectional, full duplex connection is established via one or more of Near Field Communication (NFC), WiFi or Bluetooth connectivity.

3. The method of claim 1, wherein said frequency shaping is applied to said processed constructive interference signal in accordance with a user hearing profile.

4. The method of claim 3, wherein said user hearing profile is stored on a mobile device in electrical communication with the first hearing assistance device.

5. The method of claim 1 further comprising transmitting said local audio signal to said other additional hearing assistance devices.

6. The method of claim 1 further comprising analyzing spatial differences between first hearing assistance device and said other additional hearing assistance devices.

7. The method of claim 1 further comprising connecting said first hearing assistance device to a mobile device via a radio link, said mobile device communicating data related to said combined audio signal and/or said local audio signal.

8. A hearing assistance device comprising:

a first hearing assistance device, worn by a first user, that generates a first audio signal;

a plurality of other hearing assistance devices, worn by other users, that generate additional audio signals;

a wireless transceiver that is configured to connect said first hearing assistance device to said plurality of other hearing assistance devices via a secure, bidirectional, full duplex connection, said wireless transceiver receiving said additional audio signals from said other hearing assistance devices and sending said additional audio signals to said first hearing device;

a memory containing a machine readable medium comprising machine executable code having stored thereon processor instructions;

a processor coupled to the memory, said processor configured to execute said machine executable code to cause the processor to execute said processor instructions comprising:

combing said first audio signal and said additional audio signals to create combined audio signals;

processing said combined audio signals with a digital signal processor (DSP) to enhance signal amplitude using constructive interference to create processed, combined audio signals; and sending said processed, combined audio signals through a multi-channel compressor to apply gain processing and frequency shaping to create a gain processed and frequency shaped signal;

a digital-analog converter that converts said gain processed and frequency shaped signal to an analog signal; and an output transducer adapted to generate an output in response to the analog signal.

9. The hearing assistance device of claim 8, wherein the secure, bidirectional, full duplex connection comprises at least one or more of Near Field Communication (NFC), WiFi and Bluetooth connectivity.

10. The hearing assistance device of claim 8, wherein said additional audio signals are encoded for input to a microphone channel and for combining with said first audio signal.

11. The hearing assistance device of claim 8, wherein said processor adaptively time shifts said combined audio signals, based upon spatial separation of said first hearing assistance device of said plurality of other hearing assistance devices, to enhance signal amplitude via constructive interference.

12. The hearing assistance device of claim 8, wherein said frequency shaping is in accordance with a user hearing profile.

13. The hearing assistance device of claim 8, wherein a user hearing profile is stored on a mobile device in electrical communication with said first hearing assistance device.

14. The hearing assistance device of claim 8, wherein aid processor analyzes spatial differences between said first hearing assistance device and said plurality of other hearing assistance devices.

15. The hearing assistance device of claim 8 wherein said wireless transceiver connects said first hearing assistance device to a mobile device via a radio link and communicates data related to combined audio signals and/or said first audio signal.

* * * * *